United States Patent [19]

Kim

[11] Patent Number: 4,919,601

[45] Date of Patent: Apr. 24, 1990

[54] WAVEFORM ACTUATING AIR COMPRESSOR

[76] Inventor: Jong D. Kim, 362, Chongdang-dong, Chonan-shi, Chungchongnam-do, Rep. of Korea

[21] Appl. No.: 310,745

[22] Filed: Feb. 14, 1989

[30] Foreign Application Priority Data

Feb. 15, 1988 [KR] Rep. of Korea ..... 19881581

[51] Int. Cl.[5] ..... F01C 3/06

[52] U.S. Cl. ..... 418/51; 418/53

[58] Field of Search ..... 418/53, 52, 51, 50, 418/49; 73/258

[56] References Cited

U.S. PATENT DOCUMENTS

| | | | |
|---|---|---|---|
| 1,280,689 | 10/1918 | Eck | 418/179 |
| 3,942,384 | 3/1976 | Parker | 418/53 |
| 4,125,030 | 11/1978 | Hackett | 418/53 |
| 4,229,150 | 10/1980 | Teague | 418/53 |

*Primary Examiner*—John J. Vrablik
*Assistant Examiner*—David L. Cavanaugh
*Attorney, Agent, or Firm*—Michael N. Meller

[57] ABSTRACT

An air compressor having a tilting disc which is actuated in waveform. The tilting disc is adapted to abut mounting the disc on conical surfaces of side casings by an eccentric shaft, and is moved in waveform but not rotated against the rotation of the eccentric shaft so that the intake and exhaustion of air may be realized.

10 Claims, 6 Drawing Sheets

WAVEFORM ACTUATING AIR COMPRESSOR

BACKGROUND OF THE INVENTION

1. Field of the Invention

This invention relates to an air compressor having a tilting disc which is actuated in waveform by an eccentric shaft, which is adapted to produce a high efficiency of compressed air.

2. Description of the Prior Art

It is well known that a vacuum pump comprising a plurality of blades mounted on a rotor is to be used at a pressure on the order of 1–3 kg/cm$^2$ as required. However, the aforementioned pump has some shortcomings in that large friction heat, surface wear and fracture occur due to the long distance over which friction for unit rotation, so high speed operation is almost impossible and the life is very short.

A piston type of air compressor comprising a crank and piston may be used as required at a pressure of over 3 kg/cm$^2$. Air volume in a cylinder is reduced in proportion to the pressure at a top dead center of the piston, and when the piston is moving downward to such air in the cylinder, the air of the clearance volume is expanded to the interior of the cylinder and fresh air fills the remainder of the cylinder. In this case, the maximum pressure of the compressor corresponds to the compression ratio. Under the maximum pressure, since the volume of air which may be discharged is zero, the compressor cannot change it to the energy of compressed air for necessary work so that a prime motor which drives the compressor is subjected to overload. In this case the efficiency of the compressor is zero.

Namely, since the volume of air remaining in the cylinder is increased to remain in proportion with the pressure, when the pressure is equal to the compression ratio the volume of air in the cylinder is maximum, thereby fresh air cannot enter the cylinder. Now the efficiency of the compressor is minimum or zero. If a discharge pressure increases from minimum or zero to maximum, the efficiency is changed from maximum to minimum so that total efficiency is not more than 50%. Therefore a volume of air corresponding to pressure for use remain in the cylinder, which leads to a loss of efficiency. Compressed air is discharged only when the piston is moving upward, and the discharge time of the compressed air is at when a rotation angle of the crank shaft is less than a certain angle, which equals 180° minus an angle of raising the pressure to pressure for use, so this leads to a pulsation of pressure. In order to eliminate the pulsation phenomenon, the compressor has to comprise a plurality of piston-cylinder assemblies. And in order to supply compressed air constantly, it is necessary to provide a storage tank for compressed air. In this case, since the remaining air does not circulate, the compressor tends to be damaged by heat generated therein. And, in this known compressor, because it has a complex and bulky structure, mechanical loss is increased and considerable noise is produced.

SUMMARY OF THE PRESENT INVENTION

An object of the invention is to provide a waveform actuating air compressor having a tilting disc which is actuated in waveform to compress air continuously wherein the disadvantages of conventional air compressors noted above have been overcome.

The air compressor according to the invention has a tilting disc which is adapted to abut to conical surfaces of side casings by an eccentric shaft integratedly connected and inclined relative to a rotating shaft. When the shaft is rotated, the tilting disc is moved in waveform but not rotated against the rotation of the eccentric shaft so that the intake and discharge of air may be achieved simultaneously. In this way, according to the invention, it is possible to eliminate the generation of noise and pulsation of the discharge air. Also, the air compressor of the invention may be driven at high speed and/or low speed, and a large volume of air may be discharged by the tilting disc. And it is possible to drive the air compressor of the invention without pulsation and noise so that it achieves a high efficiency in contrast to conventional air compressors.

BRIEF DESCRIPTION OF THE DRAWINGS

The invention will now be described by way of examples with reference to the accompanying drawings.

DESCRIPTION OF THE PREFERRED EMBODIMENTS

Figure 1:
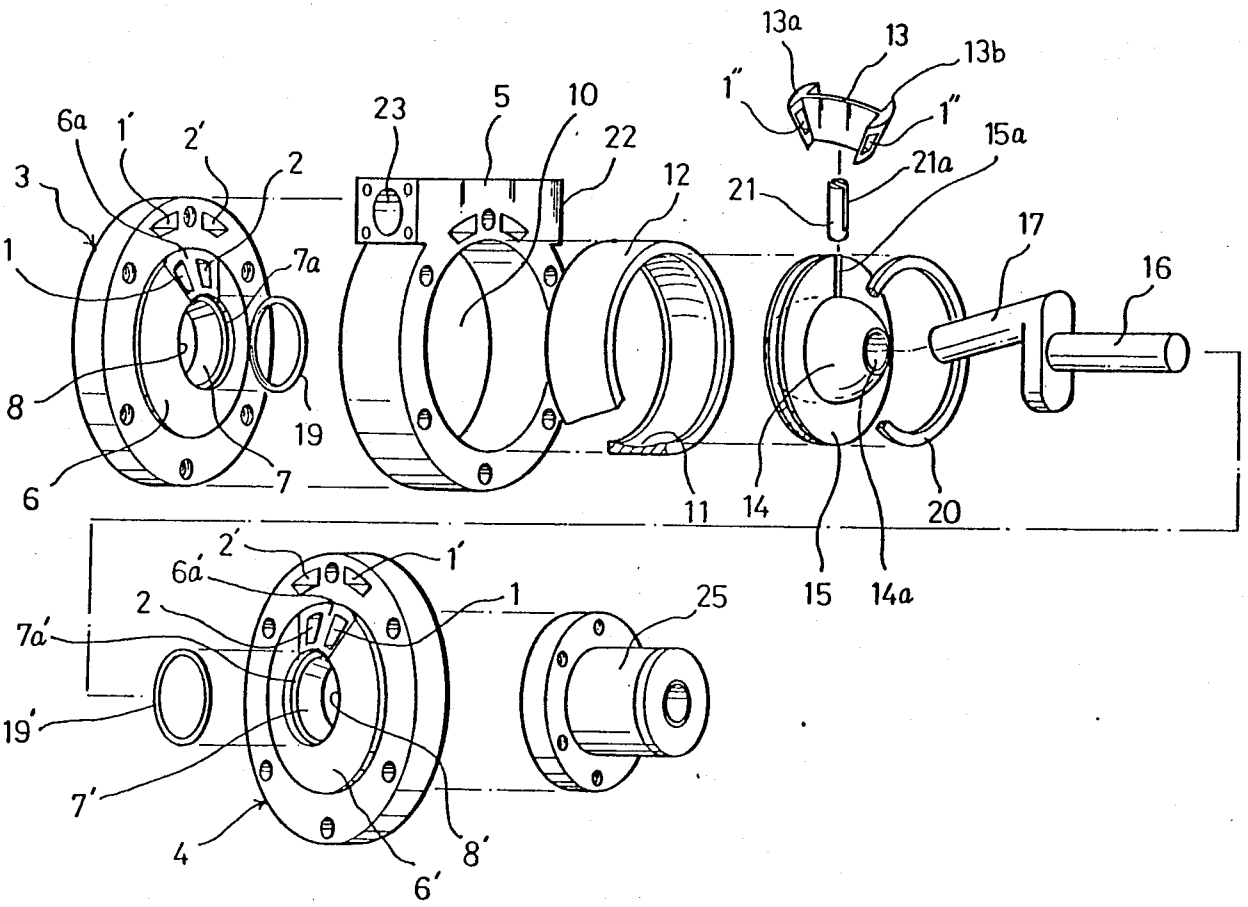
FIG. 1 is a disassembled perspective view of the invention.
Figure 2B:
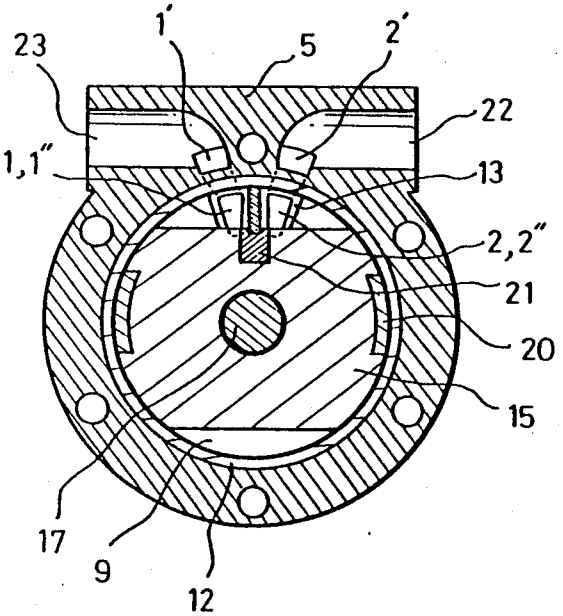
FIG. 2B is a cross-sectional view taken along a—a line of FIG. 2A, FIGS. 3A, 3B and 3C are cross-sectional views taken along line b—b which shows the operation of the tilting disc.
Figure 2A:
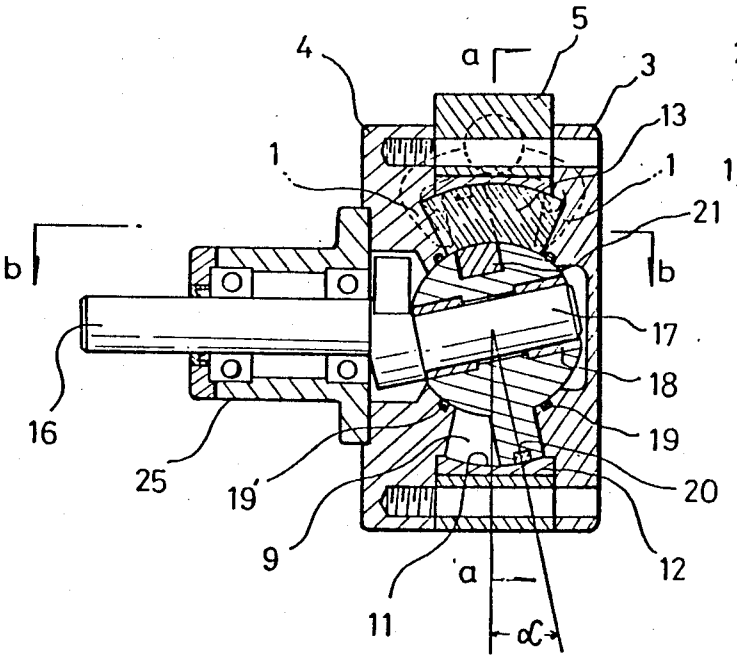
FIG. 2A is a longitudinal cross-sectional view of FIG. 1 in the assembled state.

Referring to FIGS. 2A and 2B, an air compressor of the invention comprises a main casing 5 and left and right casings 3 and 4. The left casing 3 has a conical surface 6 and a bearing bore 8 with an inner partial spherical surface 7. Also the right casing 4 which is symmetrical to the left casing 3 has a conical surface 6' and a bearing bore 8' with an inner partial spherical surface 7'. The main casing 5 and left and right casings 3 and 4 are bolted to form an air chamber 9. The conical surfaces 6,6' of the left casing 3 and right casing 4 are provided with concave grooves **6*a*, 6*a'*, respectively. An intake port 1 and an exhaust port 2 of the air compressor are formed at the concave grooves 6*a*, 6*a'* respectively. The main casing 5 has a cylindrical cavity 10 in which a liner 12 having a band-like spherical surface 11 is inserted. In the liner 12, a tilting disc 15 which has two bearing domes 14 at both sides is inserted. The tilting disc 15 is provided with a slot 15*a* for inserting a compartment plate 13 as described hereinafter. The compartment plate is H-shaped, having two wings 13*a*, 13*b* formed with rectangular bores 1'' and 2'' facing the intake and exhaust ports 1 and 2. The compartment plate 13 is inserted in the slot 15*a* by means of interposing a guiding rod 21 which has a longitudinal slot 21*a*. The disc 15 is journaled to an eccentric shaft 17 with interposing bearings 18 through a shaft bore 14*a* which is formed in both bearing domes 14. The eccentric shaft 17 is extended to a rotating shaft 16 with the longitudinal axis of eccentric shaft 17 inclined relative to that of rotating shaft 16. Therefore, when the eccentric shaft 17 is rotated eccentrically, the tilting disc 15 is moving in waveform against the conical surfaces 6, 6' of the left and right side casings 3, 4**.

Figure 4:
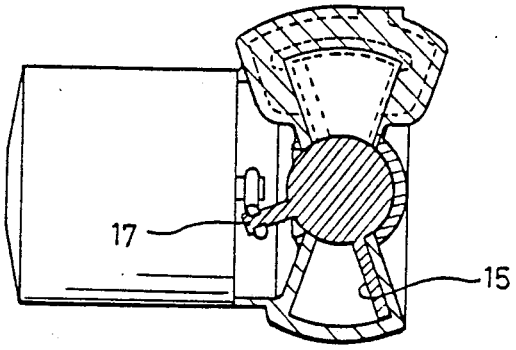
FIGS. 4 and 5 are views of two alternate embodiments.
Figure 5:
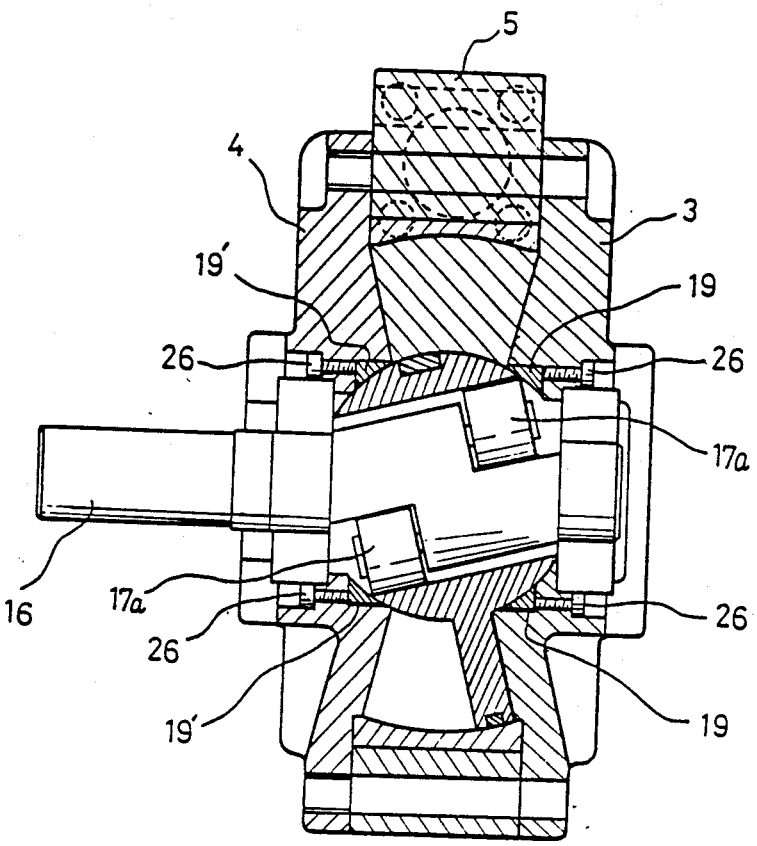
Figure 6:
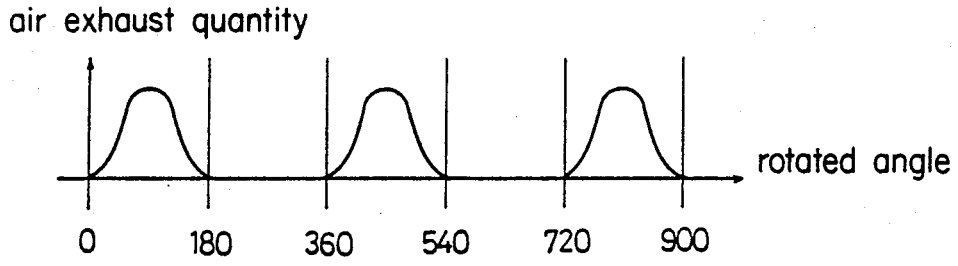
FIG. 6 is an explanatory diagram of the air discharge in a conventional air compressor.

Another two embodiments which are capable of changing the rotation force of the rotating shaft due to the actuation in waveform are shown in FIGS. 4 and 5.

As shown in FIG. 4, the eccentric shaft 17 is integrated to the tilting disc 15 so that this embodiment may be used for a water pump. If required, leakage protection accessories may be mounted around the eccentric shaft 17.

Also, as shown is FIG. 5, the rotating shaft 16 which is formed with two stages of tilting shaft is provided with rollers 17*a* so that the tilting disc 15 may be actuated in waveform as above. In this embodiment, seal rings 19, 19' which abut the inner partial spherical surfaces 7, 7' are adjusted by bolts 26 or springs (not shown) so that when the rings are worn the air-tightness of the air chamber 9 may be maintained by tightening of the bolts.

Although the compartment plate of the embodiments described above has an N-shaped cross-section, the compartment plate may be formed a flat plate as a required by design.

As shown in FIG. 2A, the angle of inclination of tilting disc 15 relative to the vertical plane of the longitudinal axis of the rotating shaft is in a range between 10° and 15°, preferably between 12° and 14°.

In the drawings, numerals 1', 2', 23 and 25 represent an air inlet, an air outlet, an air cleaner fitting and a support bearing case for rotating shaft 16, respectively.

In operation, when the rotating shaft 16 assembled as shown in FIG. 2 is rotated by a separate prime motor, the eccentric shaft 17 is so rotated eccentrically that it causes the journaled tilting disc 15 to be actuated in waveform. In this case, the bearing domes 14 of tilting disc 15 journaled to the eccentric shaft 17 slide against the bearing 18 with the bearing domes 14 slided over the inner partial spherical surfaces 7, 7' of the left and right side casings 3, 4 without escaping from the range of the seal rings 19, 19' which are inserted in the ring grooves 7*a*, 7*a'*. It can be seen that the tilting disc 15 is not rotated but actuated in waveform in the direction of rotation of the eccentric shaft by the compartment plate 13. The spherical surface 11 of the liner 12 contacts the tilting disc 15 by the ring 20 which is inserted at the periphery of the tilting disc, so that leakage of air from the air chamber is prevented. Since the tilting disc 15 abuts the conical surfaces 6, 6' in the air chamber in accordance with the displacement of position of the bearing domes 14, the tilting disc 15 is actuated to reciprocate by means of the compartment plate between the intake port 1 and the exhaust port 2 so that in the direction of rotation the tilting disc 15 may be actuated in waveform.

Figure 3A:
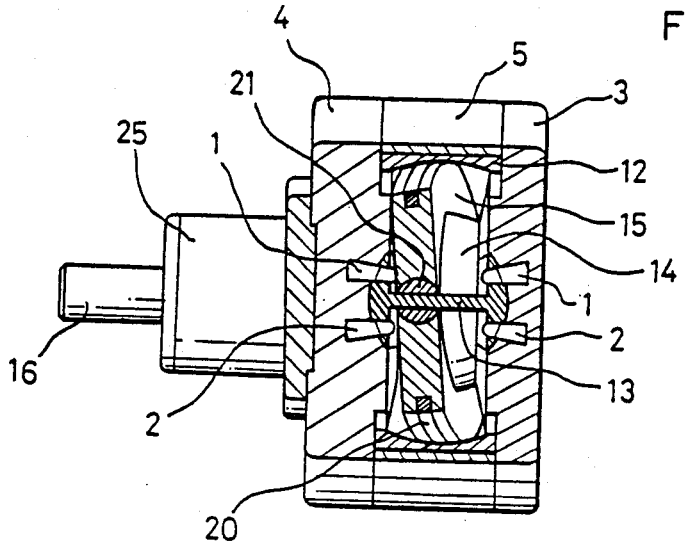
Figure 3B:
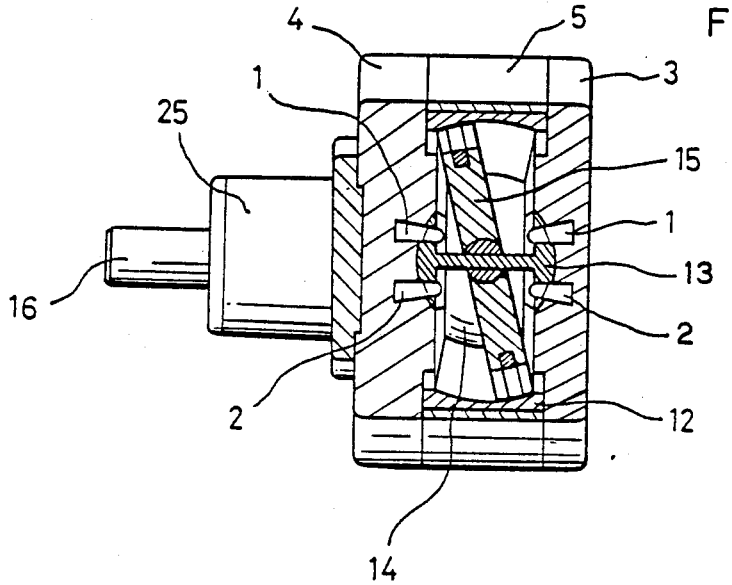
Figure 3C:
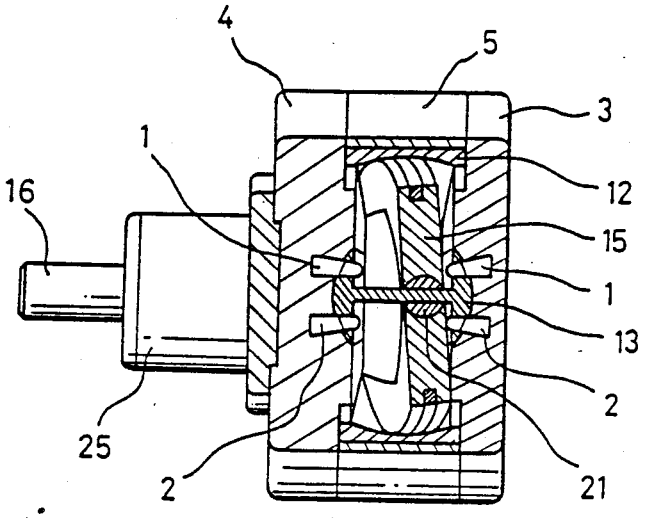

The intake and exhaustion of air by the actuation of the tilting disc 15 will be seen in FIGS. 3A, 3B and 3C. FIG. 3A, it shows that the upper portion of tilting disc 15 contacts the vicinity of exhaust port 2 which is formed in the conical surface 6' of the right side casing 4. In this case, both sides of the tilting disc 15 diametrally opposite to the aforementioned upper portion contact the portion which is diametrally opposite to the vicinity of exhaust port 2 on the left side casing 3. Displacement of the contact area between the tilting disc 15 and the conical surfaces of the left and right side casings 3 and 4 forces the air sucked from the intake port 1 from the air chamber 9 to the compartment plate 13 wherein the compressed air passes through the bore 2'' in the plate 13 to the exhaust port 2.

By rotating in succession the rotating shaft 16 and the eccentric shaft 17, the tilting disc 15 can be displaced from the state of FIG. 3B to FIG. 3C with the bearing domes 14 still contacting the inner partial surfaces 7, 7' of left and right side casings 3,4. At this time, the upper portion of tilting disc 15 adjacent to the intake port 1 will be moved away from the intake port 1 so that the volume beyond the intake port 1 will be increased. This decreases the pressure, and because of this pressure drop, fresh air enters the air chamber 9 through the bore 1'' formed in the compartment plate 13. At this time, the air chamber 9 is divided into an intake chamber and an exhaust chamber by the contact area of the compartment plate 13 between the intake port 1 and exhaust port 2 and the center of tilting disc 15, and the contact areas of the tilting disc 15 and the conical surfaces 6, 6' of side casings 3,4. By displacement of the contact areas between the tilting disc 15 and the conical surfaces 6, 6', the contact area on the basis of the compartment plate 13 is moving from the intake port 1 toward the exhaust port 2 so that the volume of the air chamber 9 adjacent to the exhaust port 2 is decreased to cause the air in the air chamber 9 to be discharged toward the exhaust fitting 22. However, when the rotating shaft 16 is rotated by 180°, the guiding rod 21 inserted at the tilting disc 15 is moved from the one side of the compartment plate 13 to the other side, resulting in the tilting disc 15 being actuated in waveform. Therefore respective volumes of the intake port side and exhaust port side are increased or decreased alternatingly to intake or discharge.

Also, when the rotating shaft 16 is rotated by 270°, the upper portion of the tilting disc 15 is displaced from the side of intake port 1 toward the exhaust port 2 so that the air sucked previously is discharged to the exhaust port 2. And, when the rotating shaft 16 is rotated by 360°, the guiding rod 21 of the tilting disc 15 is returned to the position of FIG. 3A. In this way, the tilting disc 15 continues to reciprocate between both sides of the compartment plate 13, causing discharge of the compressed air. Ring 20 is inserted on the outer periphery of tilting disc 15, which makes it possible for the tilting disc 15 to contact the spherical surfaces 11 of the air chamber 9 in an airtight manner. This prevents leakage of the compressed air so that the forces of intake and discharge would not be decreased. Meanwhile, if a liquid is used in the compressor of the invention, an intake port and an exhaust port may be formed at the main casing 5.

Figure 7:
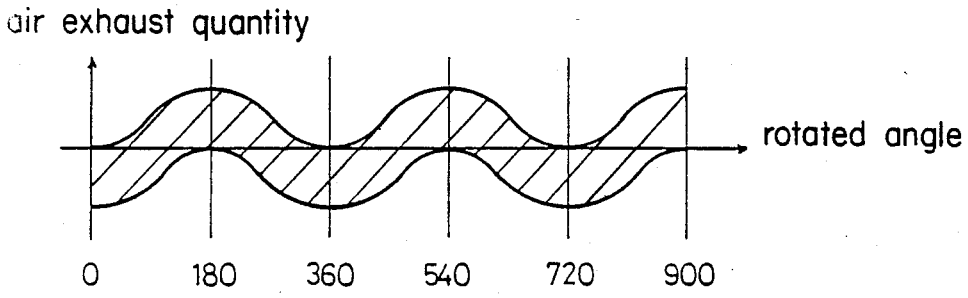
FIG. 7 is an explanatory diagram of the invention.

As described above, the invention provides an air compressor which can suck air and discharge the compressed air by means of the movement in waveform of the tilting disc 15 caused by the eccentric shaft 17 connected to the rotating shaft 16. In accordance with the invention, it is possible to discharge the compressed air continuously by maintaining the constant air volume of air chamber 9 as shown in FIG. 7, without generating noise and restricting the condition of a high speed or low speed, so that the air compressor of the invention may be utilized conveniently under any conditions and may result in high efficiency of the compressed air as small arrangement. The invention may be applied to the water pump using a well as the air compressor as described above. If required, the invention may be applied to any hydraulic or pneumatic motor.

What is claimed is:

1. A waveform actuating machine comprising:

a main casing having a cylindrical cavity in which a liner having a band-like spherical surface is inserted;

a left casing having a conical surface which forms a bearing bore with an inner partial spherical surface;

a right casing symmetrical to said left casing having a conical surface which forms a bearing bore with an inner partial spherical surface, said main casing and said left and right casings being bolted to form an air chamber;

an intake port and an exhaust port formed at concave grooves of said left and right casings; and a tilting disc having a bearing dome on each side, said disc being inserted in said liner, journaled to an eccentric shaft, and provided with a slot for inserting a compartment plate, wherein said compartment plate is H-shaped, having two wings formed with rectangular bores facing said intake and exhaust ports.

2. The machine of claim 1, wherein said eccentric shaft is integrated to said tilting disc.

3. The machine of claim 1, further comprising a rotating shaft which is formed as two stages of said tilting shaft and provided with rollers so that said tilting disc may be actuated in waveform, seal rings which abut said inner partial spherical surfaces and means for adjusting a compression of said seal rings.

4. The machine of claim 1, wherein said compartment plate is a flat plate.

5. The machine of claim 1, wherein the angle of inclination of said tilting disc relating to the vertical plane of a longitudinal axis of said rotating shaft is in a range between 10° and 15°.

6. The machine of claim 1, connected for use as a vacuum pump.

7. The machine of claim 1, connected for use as a water pump.

8. The machine of claim 1, connected for use as a pneumatic motor.

9. The machine of claim 1, connected for use as a hydraulic motor.

10. The machine of claim 1, connected for use as an air compressor.

* * * * *